US005433598A

United States Patent [19]

Joyce

[11] Patent Number: 5,433,598

[45] Date of Patent: Jul. 18, 1995

[54] BURNER

[76] Inventor: John V. Joyce, 19 Minkara Road, Bayview NSW 2104, Australia

[21] Appl. No.: 188,652

[22] Filed: Jan. 28, 1994

Related U.S. Application Data

[63] Continuation of Ser. No. 879,777, May 6, 1992, abandoned.

[30] Foreign Application Priority Data

May 6, 1991 [AU] Australia ..... PK5987

[51] Int. Cl.[6] ..... F23D 14/12

[52] U.S. Cl. ..... 431/7; 431/326; 431/328; 431/10

[58] Field of Search ..... 431/349

[56] References Cited

U.S. PATENT DOCUMENTS

| | | | |
|---|---|---|---|
| 3,199,572 | 8/1965 | Boulet | 158/116 |
| 3,245,458 | 4/1966 | Patrick | 431/329 |
| 3,681,002 | 8/1972 | Kweller | 431/268 |
| 3,726,633 | 4/1973 | Vosilakis | 431/329 |
| 4,480,988 | 6/1984 | Okabayashi et al. | 431/329 |
| 4,492,185 | 1/1985 | Kendall et al. | 122/32 |
| 4,641,631 | 2/1987 | Jatana | 126/101 |
| 4,672,919 | 6/1987 | Staats | 122/13 R |
| 4,782,815 | 11/1988 | Friedman et al. | 126/361 |
| 4,886,446 | 12/1989 | Courrege | 431/329 |
| 4,940,042 | 7/1990 | Moore, Jr. et al. | 126/344 |
| 4,993,402 | 2/1991 | Ripka | 126/361 |
| 5,016,605 | 5/1991 | LaForet et al. | 126/20 |
| 5,057,007 | 10/1991 | Andringa et al. | 431/329 X |

FOREIGN PATENT DOCUMENTS

| | | | |
|---|---|---|---|
| 6065486 | 5/1987 | Australia . | |
| 64743/90 | 4/1991 | Australia . | |
| 1037232 | 9/1953 | France | 239/568 |
| 1299103 | 6/1962 | France | 431/349 |
| 2139466 | 2/1972 | Germany | 431/349 |
| 8914576 | 3/1990 | Germany . | |
| 58-129106 | 8/1983 | Japan . | |
| 59-21909 | 2/1984 | Japan . | |
| 0057112 | 4/1985 | Japan | 431/329 |
| 6510848 | 2/1967 | Netherlands | 431/349 |
| 6515406 | 5/1967 | Netherlands | 431/349 |
| 2237104 | 4/1991 | United Kingdom | 431/329 |

*Primary Examiner*—Carl D. Price

[57] ABSTRACT

Combustion methods and burners reduce the emission of pollutants such as CO and $NO_2$ by promoting the completion of combustion reactions by at least temporarily separating ambient air from hot products of combustion.

16 Claims, 2 Drawing Sheets

BURNER

This is a continuation of application Ser. No. 07/879,777, filed May 6, 1992 abandoned.

BACKGROUND OF THE INVENTION AND RELATED ART

The present invention relates to combustion methods and burners producing very low levels of pollutants such as CO and $NO_2$.

The invention is particularly applicable to gas-fired radiant burners having a combustion surface at or near which a gaseous fuel, such as natural gas, is combusted. The burners have been developed primarily for use in respect to gas burner space heating devices and will be described with reference to this particular use. However, it should be appreciated that the invention is not limited to this particular field of use and is equally applicable to other types of gas burners as well as other burners that use a variety of different fuels.

Gas-fired burners are widely used commercially and in the domestic environment for heating including space heating for temperature conditioning interior space. Such burners are generally preferred over electricity due to their low cost and efficiency as well as their general flexibility. However, burners of all kinds are now known to be a source of indoor pollution especially in the amounts of oxides of nitrogen ($NO_x$) formed.

$NO_x$ is a term used to describe the combined oxides of nitrogen and in particular NO, $N_2O$ and $NO_2$. For example, NO and $N_2O$ are a concern in the outdoor environment, in particular with relation to acid rain, O-zone and photochemical smog. However, $NO_2$, is of more concern to medical authorities due to its affect on lung function. Medical research during the 1980's has suggested that lung function will be affected by much lower levels of $NO_2$ than was previously thought. This has led to severe restrictions on the acceptable emission levels of $NO_x$ with particular emphasis on the emission of $NO_2$.

Radiant burners which include combustion surfaces, are generally preferred over blue flame burners which tend to produce $NO_2$ in the levels in the order of 15 to 30 ng/Joule and as such are not considered to have potential for the reduction of $NO_x$. For this reason $NO_x$ gas burner research has centered primarily around surface combustion burners of different forms.

In the last twenty years, research into the production of gas burners having lower $NO_x$ emission levels has concentrated on the use of excess air, alone or in combination with the incorporation of second stage burning. As a result, a number of these burners have become very complex in both design and operation procedures.

For example, up until recently, the most successful burner design had been based on using pressurized premixed air/fuel mixtures burned in a variety of metallic surface configurations, ceramic surfaces or after-burners. All such burners relied on high excess air and high combustion load. The associated requirements of pressurizing systems, after-burners and high combustion loads resulted in gas burners that were often bulky, complicated and inflexible in their operation as well as costly.

Furthermore, while some of these burners succeeded in reducing $NO_x$ emission levels relative to the older types of burners, it still appeared impossible to approach the desired target levels.

However, a recent development in surface combustion burners as taught in Australian Patent Application No. 64743/90 and corresponding U.S. patent application Ser. No. 598,021, filed Oct. 16, 1990, owned by the assignee of this application and incorporated herein by reference, has resulted in the production of a surface combustion gas burner having unexpectedly low emission levels of $NO_x$ including both NO and $NO_2$. This burner will hereinafter be referred to as the "Bowin" burner.

The present invention arises from further development work performed initially on the low $NO_x$ burner described above. This work has shown that further substantial reductions in the emission levels of $NO_2$ can be achieved and in some cases all measurable traces of $NO_2$ can be completely eliminated. Through a series of experiments it was shown that most burners can be modified to inhibit the production of $NO_2$ in a controlled manner previously unknown within the industry.

The test work performed during development of the previously described Bowin burner indicated that the production of oxides of nitrogen can be controlled by, among other things, controlling the flame temperature within certain limits to inhibit the formation of NO. It is believed that NO is the precursor of $NO_2$ which forms by subsequent oxidation of the NO. Accordingly, by reducing the formation of NO and suppressing the combustion temperature, it was also possible to also limit the formation of $NO_2$ to very low levels.

However, up until now it has not been possible to eliminate the production of $NO_2$, completely, since at least a portion of the $NO_2$ is formed from NO outside the burner at a stage over which there is little or no control.

The present invention provides a mechanism to prevent the suspected conversion of NO to $NO_2$ by a simple technique that can be adapted to apply to most types of burners.

The radiant burners of particular interest herein are non-powered burners in that they do not include a powered fan or blower assisted supply of combustion air. A pressurized source of fuel is used to aspirate the required combustion air at levels in excess of stoichiometric for delivery to the combustion surface. Heretofore, surrounding or ambient air was freely available to the combustion process occurring at or near the combustion surface. The ambient air is typically at a relatively cooler temperature as compared with the combustion gases.

Accordingly, it is an object of the present invention to provide non-powered radiant burner apparatus and methods of combustion so as to overcome or substantially ameliorate the foregoing disadvantages of the existing prior art burners and combustion techniques. It is a further object of the present invention to enable production and operation of pertinent burner types with reduced pollutants so that emissions of CO and $NO_2$ are substantially reduced and/or eliminated.

SUMMARY OF THE INVENTION

In accordance with the present invention, the formation of pollutants is suppressed by promoting completion of the combustion reactions. Ambient air is kept separated from the hot products of combustion in order to reduce the formation of pollutants such as CO and $NO_2$. The combustion process is controlled or regulated in a manner which at least initially separates and delays the contact of the hot products of combustion with the relatively cooler ambient air.

The mechanism by which the separation of relatively cool ambient air from the hot products of combustion suppresses the formation of increased pollutants such as CO and $NO_2$ is not entirely understood. The cooler ambient air may inhibit combustion reactions which normally consume such pollutants or their precursors and effectively freeze the gas composition in an undesirable condition. Alternatively, the cold ambient air may yield or promote undesired reactions resulting in such pollutants. Further, a combination of both inhibiting desired reactions and promoting undesired reactions may occur. In any case, it has been found that the separation and/or delayed addition of ambient air to the products of combustion results in reduced pollutants, particularly, CO and $NO_2$ species.

In part, the present invention is based on the insight that the combustion reactions in respect to pollutants may be significantly altered by regulation of the combustion process adjacent the combustion surface. That is, it has been determined that the levels of various pollutants may be substantially reduced by restricting, regulating or controlling the ambient air flow to the combustion at or near the surface itself. In other words, it has been discovered that the combustion phenomenon may be substantially affected by process controls and apparatus substantially operating or disposed only in close proximity to the combustion surface. For example, processing and apparatus within less than about one inch spacing from the surface have been found to effectively suppress the formation of CO and $NO_2$ in the resulting flue gas. Consistent with these process and apparatus developments, it has been found that the majority of combustion reactions tend to occur and to be completed in relatively close proximity to the combustion surface in a radiant burner. Laser fluorescence techniques indicate that the maximum concentrations of various reactive molecular species occur within about one inch of the combustion surface at temperatures in the range of about 830° to 8700° C.

The present invention is also founded on the realization that the application of the foregoing process and apparatus controls to a radiant combustion surface may be effected at the combustion surface periphery or extremities. Accordingly, the separation of the ambient air from the hot products of combustion at the periphery of the combustion surface and in close proximity therewith effectively reduces the levels of pollutants. It is believed that the interior regions of the combustion surface are effectively shielded from deleterious ambient air contact or effects by the hot combustion products themselves as they rise upwardly due to their natural buoyancy.

In the illustrated embodiments, radiant burners having controlled ambient air flow in accordance with the invention have been found to produce reduced levels of pollutants as compared with otherwise identical burners not having controlled ambient air. In accordance with the invention, primary combustion air is provided at levels in excess of stoichiometric or that required for theoretically complete combustion so that no secondary combustion air is required.

This control is achieved via burner isolation in a first embodiment. More particularly, a non-powered radiant burner has a combustion surface contained within a sealed or closed combustion chamber which is vented to the atmosphere via a natural draft vent.

In a second embodiment, a radiant burner includes an air baffle or barrier extending along the burner periphery adjacent the burner surface to restrictively control the ingress of ambient air into the burner flames and/or hot products of combustion adjacent the combustion surface. The barrier extends along a majority of the periphery of the combustion surface so as to restrict the direct lateral flow of ambient air onto the combustion surface.

DETAILED DESCRIPTION OF THE DRAWINGS

Figure 1:
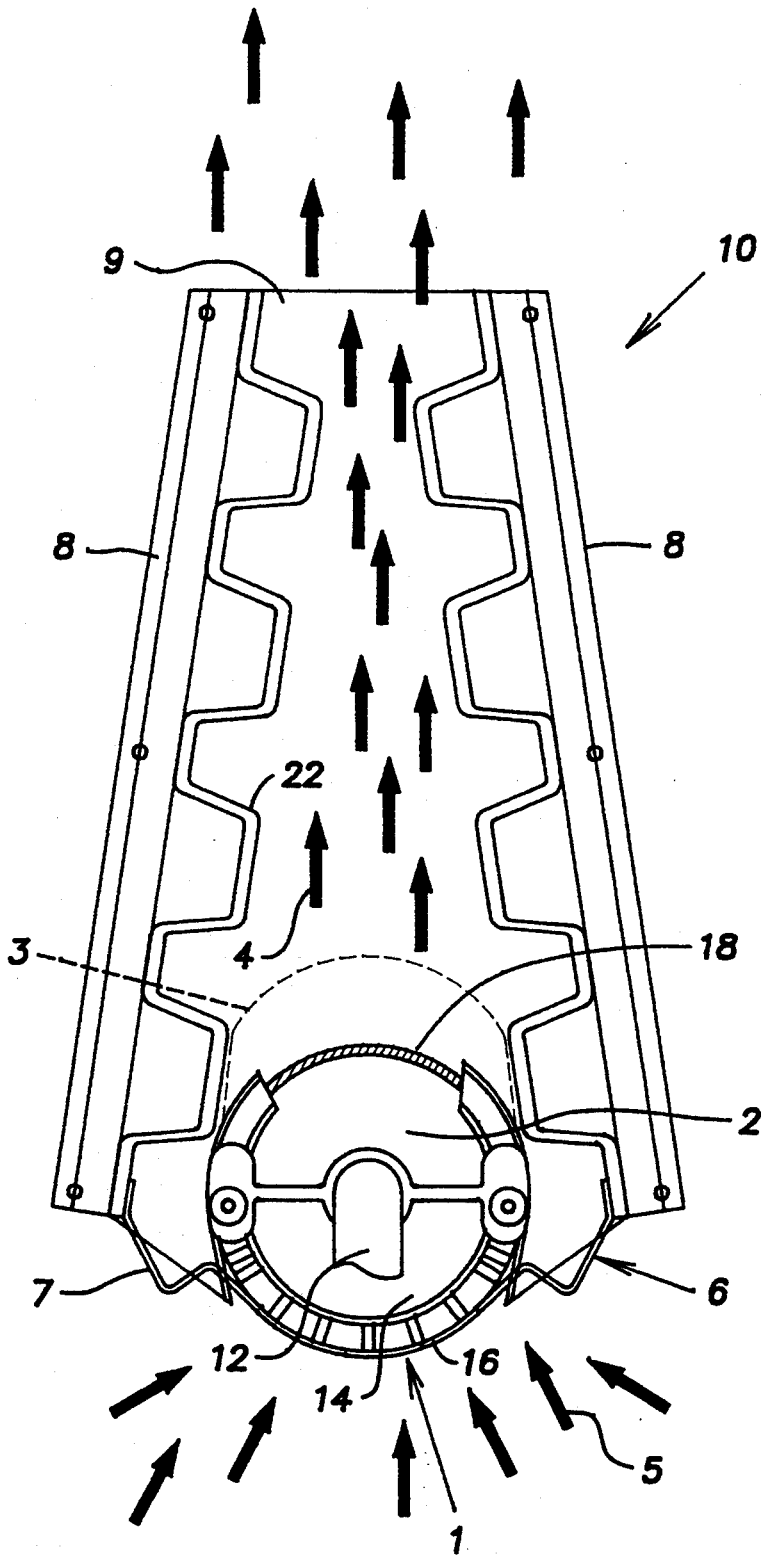
FIG. 1 is an elevational end view, partly in section, showing a burner apparatus in accordance with the invention with parts broken away or omitted for clarity of illustration.

A burner apparatus comprising a space heater 10 suitable for indoor heating is shown in FIG. 1. The heater 10 includes a gas-fired burner 1 of the type referred to herein as a "Bowin" burner and described in detail in the above mentioned Australian Patent Application No. 64743/90 and corresponding U.S. Patent Application Ser. No. 598,021. The details of burner 1 may be obtained by reference to the foregoing applications.

The burner 1 includes an air inlet and fuel mixing device generally indicated at 2 arranged to deliver a combustible air/fuel mixture to a combustion zone generally indicated at 3. More particularly, the mixing device 2 comprises a fuel gas injector nozzle 12 arranged to deliver a flow of fuel gas into a venturi 14 with aspiration and mixing of a primary air component to form the combustible air/fuel mixture. The air/fuel mixture is delivered by the venturi into a tubular plenum chamber 16 for distribution to a porous combustion surface 18 formed of wire mesh, sintered metal or ceramic material in a known manner. The air/fuel mixture passes through the combustion surface 18 with combustion occurring at or near the combustion surface 18 within the combustion zone 3. The combustion along the surface 18 includes a plurality of flames extending from associated openings in the surface 18 to a height generally less than the height of the combustion zone.

The hot products of combustion or flue gases indicated by the arrows 4 rise due to their natural buoyancy. Ambient air indicated by the arrows 5 is prevented from contacting and/or mixing with the reactive species of the flue gas 4 by the housing 6. The housing 6 includes a base portion 7 which extends from the plenum chamber 16 to housing sidewalls 8. The sidewalls 8 terminate at an upper opening 9 provided for venting the flue gas 4 to the atmosphere.

The lower interior region of the housing 6 forms a combustion chamber 20 which encloses the combustion surface 18. More particularly, the housing base portion 7 cooperates with a lower portion of a corrugated interior housing wall 22 to enclose the combustion surface 18 and the combustion zone 3 to prevent contact of the combustion products or flue gas with ambient air. The combustion products move upwardly from the combustion surface 18 and away from the combustion zone 3 due to their natural buoyancy for venting to the atmosphere through the upper portion of the housing 6 for discharge via opening 9. It should be appreciated that combustion reactions are completed and the flue gas 4 is cooled by time it reaches the opening 9. The flue gas 4 may be cooled by recovery of heat energy therefrom via indirect heat transfer and radiant heat transfer.

Through a series of tests it was shown that by preventing the ambient air 5 from coming into contact with the hot reactive combustion species until they reach the opening 9, the production of CO and $NO_2$ can be inhibited. The housing 6 is designed to facilitate cooling of the flue gas 4. The burner 1 is provided with at least 100% premixed primary air, and it is capable of running in a totally sealed enclosure where the hot reactive combustion products have no interaction with the ambient air as described above. Because of this arrangement, the heater 10 enjoys an added benefit of being capable of running at much higher efficiencies than contemporary burner configurations. This is due to the relatively lower volumes of air flow through the combustion chamber 20 which reduces the energy losses from the system.

In the heater 10, it is possible to use a fairly large housing 6 and to fully enclose the burner 1. This results in the substantially complete elimination of all measurable $NO_2$ from the exhaust products. The temperature of the exhaust/ambient air mixture at the point of measuring was approximately 550° C.

Figures 2, 3:
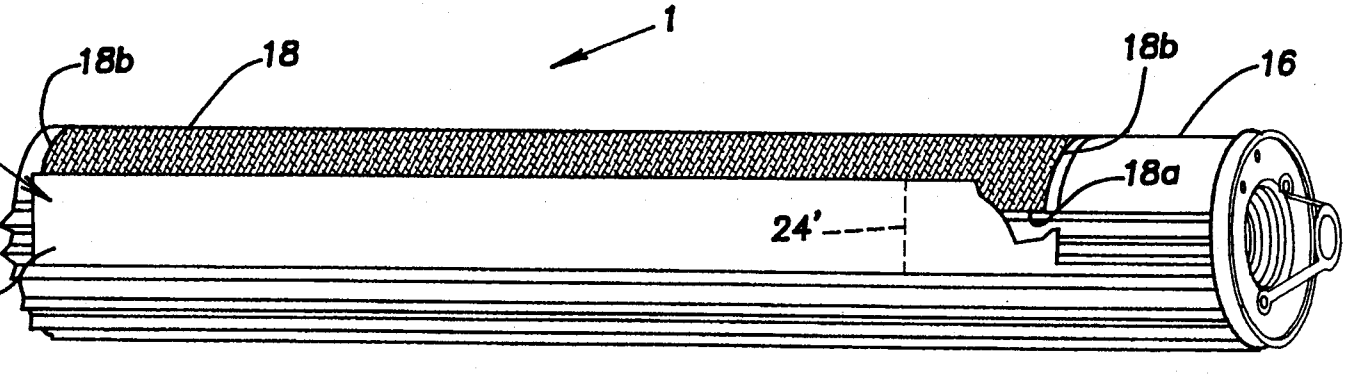
FIG. 2 is a perspective view showing a burner in accordance with a second embodiment of the invention with parts broken away or omitted for clarity of illustration.
FIG. 3 is an elevational end view of the burner of FIG. 2.

Referring to FIG. 2, a second embodiment of the invention is shown and described hereinafter with the use of similar reference numerals for like parts and the addition of a prime designation to indicate modified parts or arrangements. A burner 1 has a modified housing 6' comprising a pair of baffle or barrier walls 24 which extend along a major portion of the periphery of the combustion surface 18. In this embodiment, relatively cooler ambient air is prevented from direct lateral flow into the combustion zone 3 adjacent the combustion surface 18.

The combustion zone 3 extends a small distance, e.g. equal to at least the flame height and usually about 0.5 to 1 inch or more, above the combustion surface 18 depending upon the combustion loading, the size of the openings in the combustion surface and other burner operating characteristics. The hot products of combustion within the zone 3 contain the maximum concentrations of reactive molecular species and they are maintained separate from significant contact with relatively cooler ambient air in accordance with the invention. It was found therefore that the simple expedient of a shroud or baffle in the path from which the ambient air was to be admitted, so as to provide a labyrinthine type ambient air by-pass, is effective to substantially prevent the production of $NO_2$.

The barrier walls 24 comprise elongate strips of metal about one inch wide mounted to the burner 1 in a suitable manner such as by threaded fasteners. The walls 24 are imperforate and extend along a major portion of the periphery of the combustion surface 18. As shown by dotted outline, a wall portion 24' may be omitted to provide clearance for other burner apparatus such as a pilot lighting device.

Each of the walls 24 is disposed in a plane parallel to a plane passing through a diameter of the tubular plenum chamber 16 of the burner and radially spaced from the outer periphery of the burner by a distance of about 0.25 inch. Each of the walls 24 extends away from the combustion surface 18 in a direction generally corresponding with the direction of flow of the flue gases due to their natural buoyancy. As shown in FIG. 3, the combustion surface 18 has a semi-cylindrical configuration including major longitudinal edges **18*a* connected by arcuate end edges 18*b*. The periphery of the combustion surface 18 extends along the opposed pairs of longitudinal edges 18*a* and end edges 18*b*. The combustion surface 18 is secured to the burner 1 by a crimp arm 26 extending along each of the major edges of the combustion surface 18. Each of the walls 24 extends beyond the associated crimp arm 26 and combustion surface edge 18*a* a distance equal to about 0.3 inch or 8 mm. The walls 24 may extend a greater distance beyond the combustion surface edge 18*a* in accordance with the size of the combustion zone 3** and other operating characteristics of the particular burner as well as the desired reduction in pollutant emission levels. This distance may be easily determined by trial and error.

The barrier walls 24 have been found effective to reduce the level of $NO_2$. Further, the rapid influx of relatively cool ambient air is believed to yield increased amounts of CO, at least in part, due to excessive reduction of the flue gas temperature. The barrier walls 24 are therefore effective in reducing pollutant levels.

In accordance with the embodiment of FIGS. 2 and 3, variously sized burners were operated with and without barrier walls 24 to demonstrate the effectiveness of the present invention to reduce levels of pollutants. Each barrier wall 24 extended above the associated lowermost edge **18*a* of the combustion surface 18 a distance of about 0.3 inch in the direction of flue gas flow as described above in respect to the burner 1. Each burner was operated with free access to ambient air so that the effects of the barrier walls 24** could be compared. The results of these tests are reported below in Table I.

TABLE I

| BURNER INPUT[1] | SCREEN SIZE[2] LEN. × WID. | PERIPHERAL PERCENT[3] | WITH BARRIER | | WITHOUT BARRIER | |
|---|---|---|---|---|---|---|
| | | | $CO/CO_2$ | $NO_2$[4] | $CO/CO_2$ | $NO_2$[4] |
| 9 MJ | 178 × 86 | 54.8 | 0.007 | 3.5 | 0.006 | 3.9 |
| 17 MJ | 360 × 86 | 73.5 | 0.005 | 2.3 | 0.009 | 3.6 |
| 22 MJ | 490 × 86 | 79.6 | 0.005 | 1.5 | 0.010 | 2.1 |
| 28 MJ | 490 × 102 | 77.4 | 0.004 | 2.3 | 0.007 | 3.1 |

[1]Megajoules/$m^2$ hr
[2]Millimeters
[3]Percent of combustion surface edge or periphery along which the barrier wall extends
[4]Nanograms/joule The tested burners were of various sizes having burner input ratings ranging from 9 to 28 MJ/$m^2$hr as indicated in Table I. The combustion surfaces were formed of three tightly secured layers of 30×32, 0.014 inch diameter, nickel-based steel wire having an overall porosity of about 32%. For each burner size, CO and $NO^2$ pollutants were measured in the vented flue gases at steady state operating conditions. The $CO/CO_2$ ratio was calculated based on CO and $CO_2$ measured values using standard techniques. The $NO_2$ values were measured using a Bendix 8101-B oxides of nitrogen analyzer or a Neotronics Exotox 75 analyzer.

As shown by the results of Table I, the barriers 24 are surprisingly effective in reducing $NO_2$ levels; the improvements ranging from about 11% to 40% reduction. The percent reduction is indicated to be proportional to the peripheral percent of the combustion surface which is shielded by a barrier wall. The shielding of a major portion of the periphery of the combustion surface results in about a 10% reduction in $NO_2$ level. The $CO/CO_2$ ratio also tends to be reduced as increased proportions of the combustion surface periphery are shielded by the barrier wall.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not limited in scope and effect to the specific embodiments herein shown and described nor in any other way that is inconsistent with extent to which the progress in the art has been advanced by the invention.

I claim:

1. A method of combusting a gaseous fuel in a gas burner apparatus having a naturally aspirated radiant burner including a combustion surface having a periphery comprising mixing said fuel with a preselected amount of combustion air greater than the amount required for theoretically complete combustion of said fuel to form an air/fuel mixture, delivering said air/fuel mixture to said combustion surface, combusting said air/fuel mixture in a single combustion zone adjacent to said combustion surface to form reactive molecular species in said zone, and providing an imperforate elongate wall to substantially restrict the addition of relatively cooler ambient air to said reactive molecular species in said combustion zone prior to the substantial completion of reactions of combustion and to thereby suppress the formation of CO and $NO_2$ in hot products of combustion exiting said zone, said elongate wall including one or more wall portions, said elongate wall extending along a major portion of the periphery of said combustion surface and projecting from said combustion surface in the direction of flame buoyancy a distance not substantially greater than the full height of said combustion zone.

2. A method as in claim 1, including cooling said products of combustion as they move away from said combustion surface and combustion zone prior to venting them to the atmosphere.

3. A method as in claim 1, wherein said major portion of said periphery is equal to at least about 50% of the periphery of said combustion surface.

4. A method as in claim 1, wherein said major portion of said periphery is equal to at least about 70% of the periphery of said combustion surface.

5. A method as in claim 1, wherein said elongate wall has a height of from about 0.5 to about 1 inch as measured in the direction of flame buoyancy.

6. A method as in claim 1, wherein said elongate wall includes at least two of said wall portions and each of said wall portions is mounted to said burner to form said elongate wall and prevent said flow of ambient air.

7. A method of combusting a gaseous fuel in a gas burner apparatus having a naturally aspirated radiant burner including a combustion surface having a periphery comprising mixing said fuel with a preselected amount of combustion air greater than the amount required for theoretically complete combustion of said fuel to form an air/fuel mixture, delivering said air/fuel mixture to said combustion surface, combusting said air/fuel mixture in a single combustion zone adjacent to said combustion surface to form hot products of combustion containing reactive molecular species, and separating by imperforate wall means said hot products of combustion from relatively cooler ambient air at least along a major portion of the periphery of said combustion surface prior to the substantial completion of reactions of combustion and to thereby suppress the formation of CO and $NO_2$ as compared with an otherwise identical combustion method which does not include said separating step, said wall means projecting from said combustion surface in the direction of flame buoyancy a distance no greater than about the full height of said combustion zone.

8. A method as in claim 7, including the steps of moving said hot products of combustion away from said combustion surface and cooling said hot products of combustion prior to permitting them to contact relatively cooler ambient air in amounts otherwise sufficient to result in an increased level of $NO_2$.

9. A gas-fired burner apparatus including a naturally aspirated radiant burner having a combustion surface for combusting an air/fuel mixture to form reactive molecular species in a single combustion zone which further react to form hot products of combustion and gas flow means for removing said products of combustion from said apparatus, said gas flow means including imperforate wall means to substantially prevent contact of said reactive molecular species with relatively cooler ambient air prior to the substantial completion of reactions of combustion whereby the formation of increased amounts of CO and $NO_2$ is suppressed as compared with an otherwise similar burner apparatus which does not include said imperforate wall means, said wall means projecting from said combustion surface in the direction of flame buoyancy a distance not substantially exceeding the height of said combustion zone and obstructing the flow of ambient air directly to said combustion zone from the lateral extremities thereof.

10. An apparatus as is claim 9, wherein said combustion surface has a periphery and said wall means extend along a major portion of the periphery of said combustion surface.

11. An apparatus as in claim 10, wherein said wall means extends along at least about 50% of the periphery of said combustion surface.

12. An apparatus as in claim 10, wherein said wall means extends along at least 70% of the periphery of said combustion surface.

13. An apparatus as in claim 9, wherein said wall means comprise at least one wall.

14. An apparatus as in claim 13, wherein said wall has a wall height extending from a lower boundary on said burner below said combustion surface to an upper boundary positioned above said periphery of said combustion surface a distance of at least about 0.3 inch, said wall also having a wall length extending along at least about 50%of the periphery of said combustion surface.

15. An apparatus as in claim 14, wherein said wall means includes a second wall member which extends from said burner, and said wall members together extend along at least about 70% of the periphery of said combustion surface.

16. An apparatus as in claim 10, wherein said wall means comprises an elongate strip of metal having opposed first and second longitudinal edges, said first longitudinal edge being secured to said burner and said second longitudinal edge being positioned above said periphery of said combustion surface.

* * * * *

UNITED STATES PATENT AND TRADEMARK OFFICE

CERTIFICATE OF CORRECTION

PATENT NO. : 5,433,598
DATED : July 18, 1995
INVENTOR(S) : John V. Joyce

It is certified that error appears in the above-indentified patent and that said Letters Patent is hereby corrected as shown below:

On the title page, item [73] Assignee, should read--

Bowin Designs Pty. Ltd., Australia--.

On the title page, before item [57] add Attorney , agent or firm:

--Pearne, Gordon, McCoy & Granger, Cleveland, Ohio--.

Column 1, line 31, delete "$N_zO$" and insert --$N_2O$--.

Column 3, line 41, delete "8700°C" and insert --870°C--.

Signed and Sealed this

Thirteenth Day of August, 1996

Bruce Lehman

*Attest:*

BRUCE LEHMAN

*Attesting Officer*

*Commissioner of Patents and Trademarks*